US005887836A

United States Patent [19]

Back

[11] Patent Number: 5,887,836

[45] Date of Patent: Mar. 30, 1999

[54] MOUNTING BRACKET ASSEMBLY

[76] Inventor: Jeffrey D. Back, 7 Telford St., Oneonta, N.Y. 13820

[21] Appl. No.: 888,810

[22] Filed: Jul. 7, 1997

[51] Int. Cl.[6] ..... A47B 96/06

[52] U.S. Cl. ..... 248/221.11; 248/220.21

[58] Field of Search ..... 248/220.21, 221.11, 248/223.41, 225.11, 313; 312/334.12

[56] References Cited

U.S. PATENT DOCUMENTS

| | | | |
|---|---|---|---|
| 3,902,932 | 9/1975 | Gdanski | 248/313 |
| 4,030,788 | 6/1977 | Bleeker | 312/334.12 |
| 4,190,306 | 2/1980 | Litchfield et al. | 312/334.12 |
| 4,460,141 | 7/1984 | Svensson | 248/223.41 |
| 4,889,306 | 12/1989 | Boucher | 248/313 |
| 5,390,886 | 2/1995 | Lawner et al. | 248/224.7 |

*Primary Examiner*—Leslie A. Braun
*Assistant Examiner*—Robert Lipcsik
*Attorney, Agent, or Firm*—Salzman & Levy

[57] ABSTRACT

A quickly assembled and disassembled mounting bracket assembly for cylindrical objects, such as pressurized gas (e.g., oxygen) tanks, is described. The bracket assembly has two interconnecting parts: a bracket section and a base plate. The bracket section is slidable within the base plate, similar to a rail system. The two interconnecting pieces slidably interlock via spaced-apart T-shaped connectors disposed on distal side portions thereof. Assembly movement is minimal so that the two pieces can be joined quickly. Limiting stops provide mating alignment. Once in the aligned position, one or more locking detent pins are inserted through alignment holes disposed in the mating sections to secure the two parts in place.

11 Claims, 9 Drawing Sheets

MOUNTING BRACKET ASSEMBLY

FIELD OF THE INVENTION

This invention relates to mounting brackets and, more particularly, to a rapid mounting assembly featuring a pair of interconnecting mounting brackets for accommodating curved or flat objects.

BACKGROUND OF THE INVENTION

Scuba diving is a very popular activity. One of the time consuming inconveniences of getting prepared for a scuba dive is mounting the oxygen tanks to the harness worn about the torso of the diver. The oxygen cylinders are fairly heavy and bulky, thus making the mounting procedure particularly cumbersome and difficult. Oxygen cylinders are also worn by fire fighters and rescue personnel working in hazardous locations.

Presently, a very common way of securing these tanks to the harness is by tightening a band that is attached to the harness. The band girdles the circumference of the cylinder. Multiple oxygen cylinders are typically held together with a banding assembly which provides proper alignment of the cylinders relative to the valve manifold. The banding assembly is commonly attached to the harness via bolts passing through the cylinder bands.

Adjusting the above mounting apparatus is often very time consuming, because once the belting is loosened, the alignment must be reconfigured. Precise adjustment is necessary because nylon webbing, that can loosen when wet, creates the potential for the primary cylinder to slip from the harness during a dive.

Accordingly, it would be very useful to be able to quickly mount and remove the heavy and bulky oxygen tanks or other cylinders from a support harness.

The present invention introduces a quickly assembled and disassembled mounting bracket system for oxygen tanks. The two interconnecting parts comprise a bracket section and a mounting plate section. The bracket section is slidable within the mounting plate base, similar to a rail system. The two interconnecting pieces slidably interlock via spaced-apart T-section connectors. Movement during assembly is minimal. The two pieces are quickly joined. Limiting stops provide mating alignment. Once in the aligned position, two locking detent pins are inserted through alignment holes disposed in the mating sections to secure the two parts in place.

The mounting assembly, while most usefully employed for oxygen tanks, can also be used to mount similar items, such as pony bottles.

DISCUSSION OF RELATED ART

In U.S. Pat. No. 5,390,886, issued to Lawner et al, on Feb. 21, 1995, for SCUBA ACCESSORY INTERCHANGE SYSTEM, a quick disconnect device is shown for slidably interconnecting a female bracket attached to one scuba tank, with a male bracket. The interconnection is secured in place by means of a detent pin, similar to the present invention. The problem with the Lawner et al design is that the locking feature is totally dependent upon the detent pin. Should this detent pin shear, the mounting pieces are, unfortunately, free to disassemble.

By contrast, the present invention uses a plurality of interlocking T-sections for securing the two mating parts. The T-sections act as frictional guides that join the two sections in mating assembly. The internal stops provide accurate alignment of the mating parts. The two locking detent pins on each side of the bracket assembly provide redundant locking of the mating sections.

SUMMARY OF THE INVENTION

In accordance with the present invention, there is provided a quickly assembled and disassembled mounting bracket system for oxygen tanks. The bracket system comprises two interconnecting parts, a bracket section and a base plate. The bracket section is slidable within the base plate, similar to a rail system. The two interconnecting pieces slidably interlock via spaced-apart T-shaped connectors disposed on distal side portions thereof. Assembly movement is minimal, so that the two pieces can be joined quickly. Limiting stops provide mating alignment. Once in the aligned position, two locking detent pins are inserted through alignment holes disposed in the mating sections to secure the two parts in place.

It is an object of this invention to provide an improved mounting assembly for pressurized gas (e.g., oxygen) tanks.

It is another object of the invention to provide a quickly assembled and disassembled mounting system for oxygen tanks.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same designation and numbering throughout the figures.

DESCRIPTION OF THE PREFERRED EMBODIMENT

Generally speaking, the invention features a mounting assembly for oxygen tanks and other vessels. The mounting assembly provides a quick assembly and disassembly of the oxygen tanks to a support harness or other body adaptor.

Figure 1:
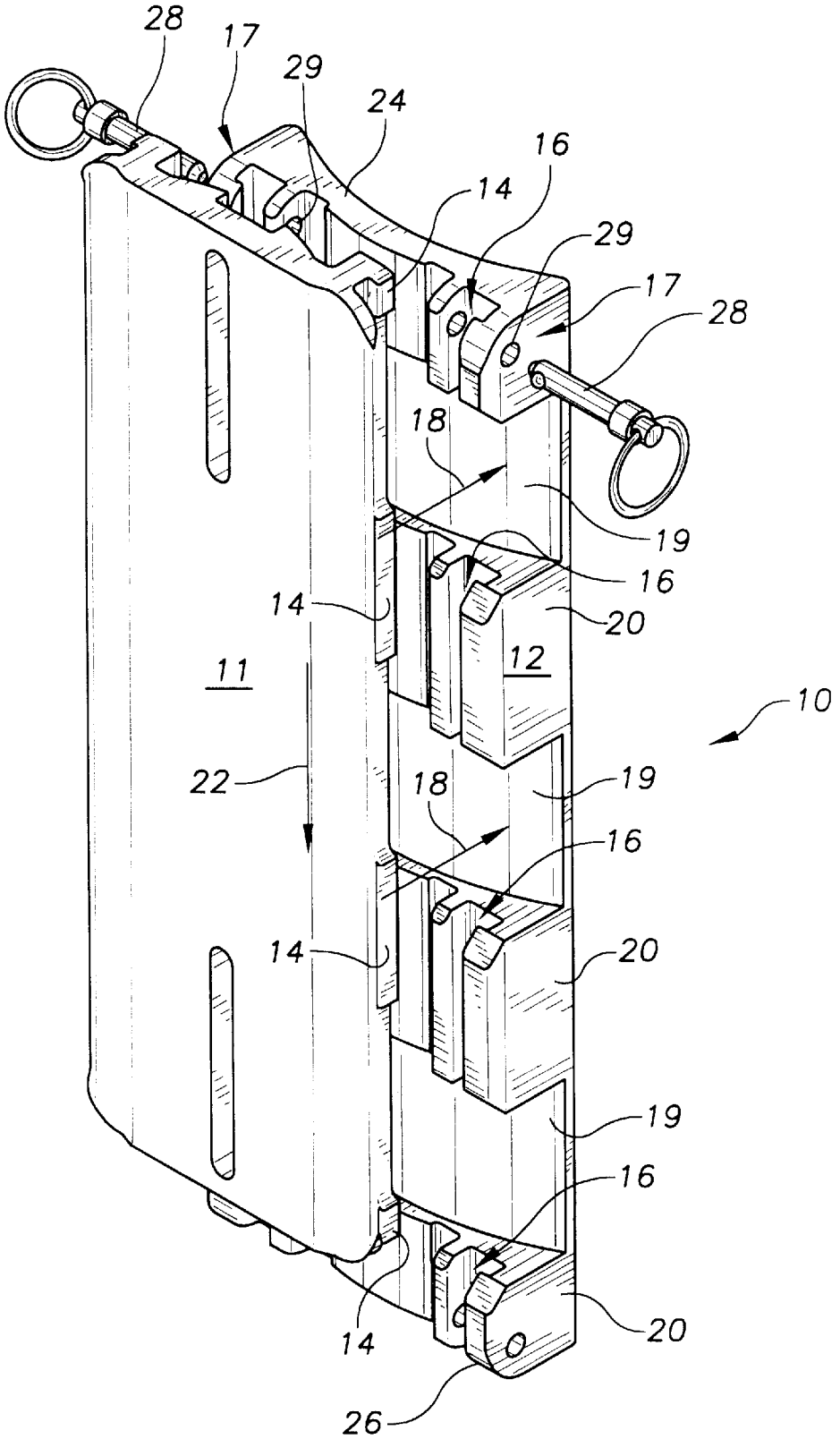
FIG. 1 illustrates a perspective, exploded view of the oxygen tank mounting assembly of this invention, with the mounting assembly shown in the disassembled position.

Now referring to FIG. 1, a perspective, exploded view of the oxygen tank mounting assembly 10 of this invention is illustrated. The mounting assembly 10 is shown disassembled. The mounting assembly 10 comprises two mating parts: a base plate 11 and an oxygen tank mounting bracket 12. The base plate 11 is shown in more detail with reference to FIGS. 1*a* and 1*b,* which depict the base plate 11 in respective back and front perspective views. The oxygen tank mounting bracket 12 is illustrated in more detail with reference to FIGS. 1*c* and 1*d*, which show the mounting bracket 12 in a back and front perspective view, respectively. Mounting bracket 12 has an outer curved surface 24 that conforms to the cylindrical shape of an oxygen tank (not shown). The oxygen tank rests upon surface 24, and then straps to the mounting bracket 12 by flexible, nylon bands (not shown) that girdle the mounting bracket 12 through spaces 19.

Figure 1A:
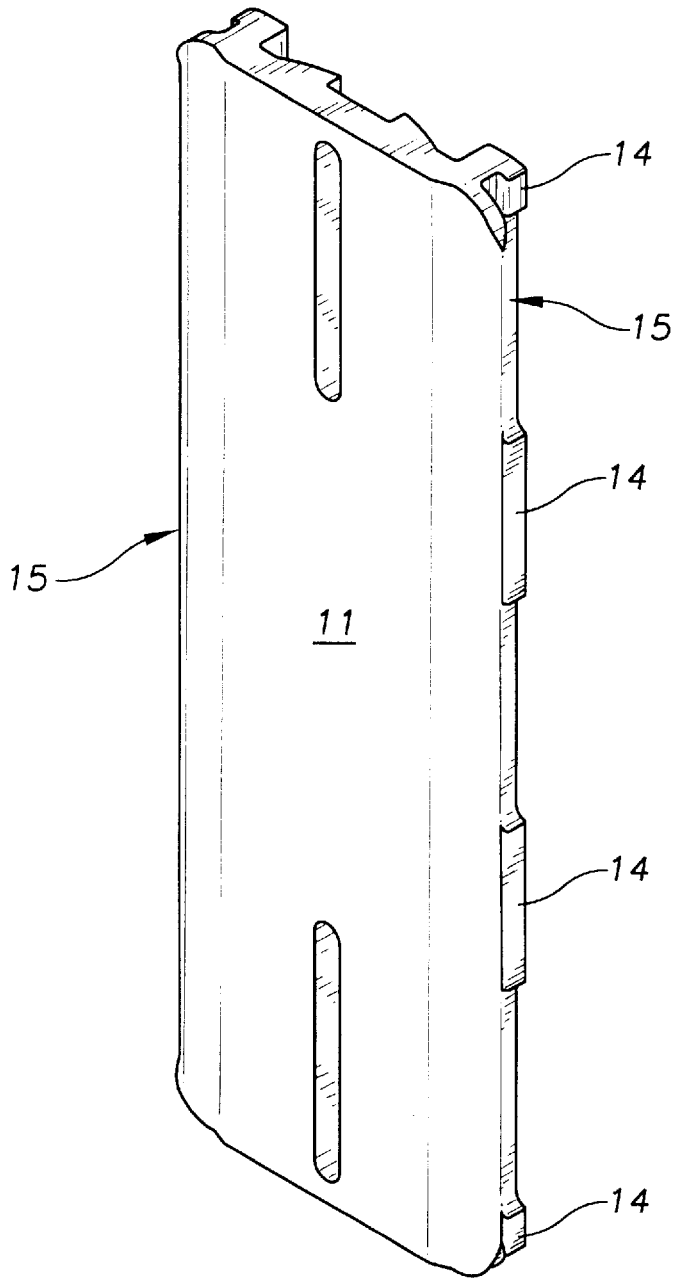
FIG. 1*a* shows a back perspective view of the base plate of the oxygen tank mounting assembly depicted in FIG. 1.
Figure 1B:
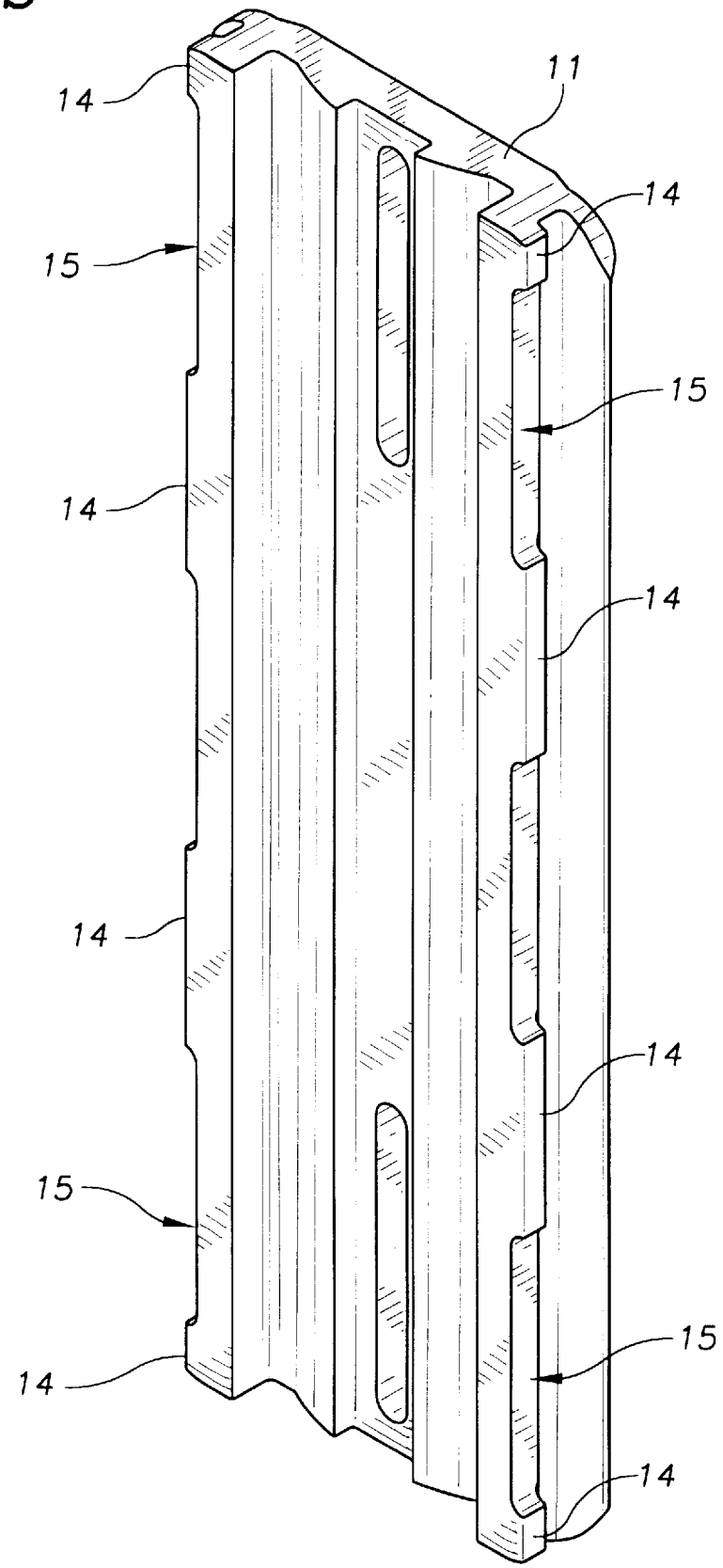
FIG. 1*b* depicts a front, perspective view of the base plate of the oxygen tank mounting assembly depicted in FIG. 1.
Figure 1C:
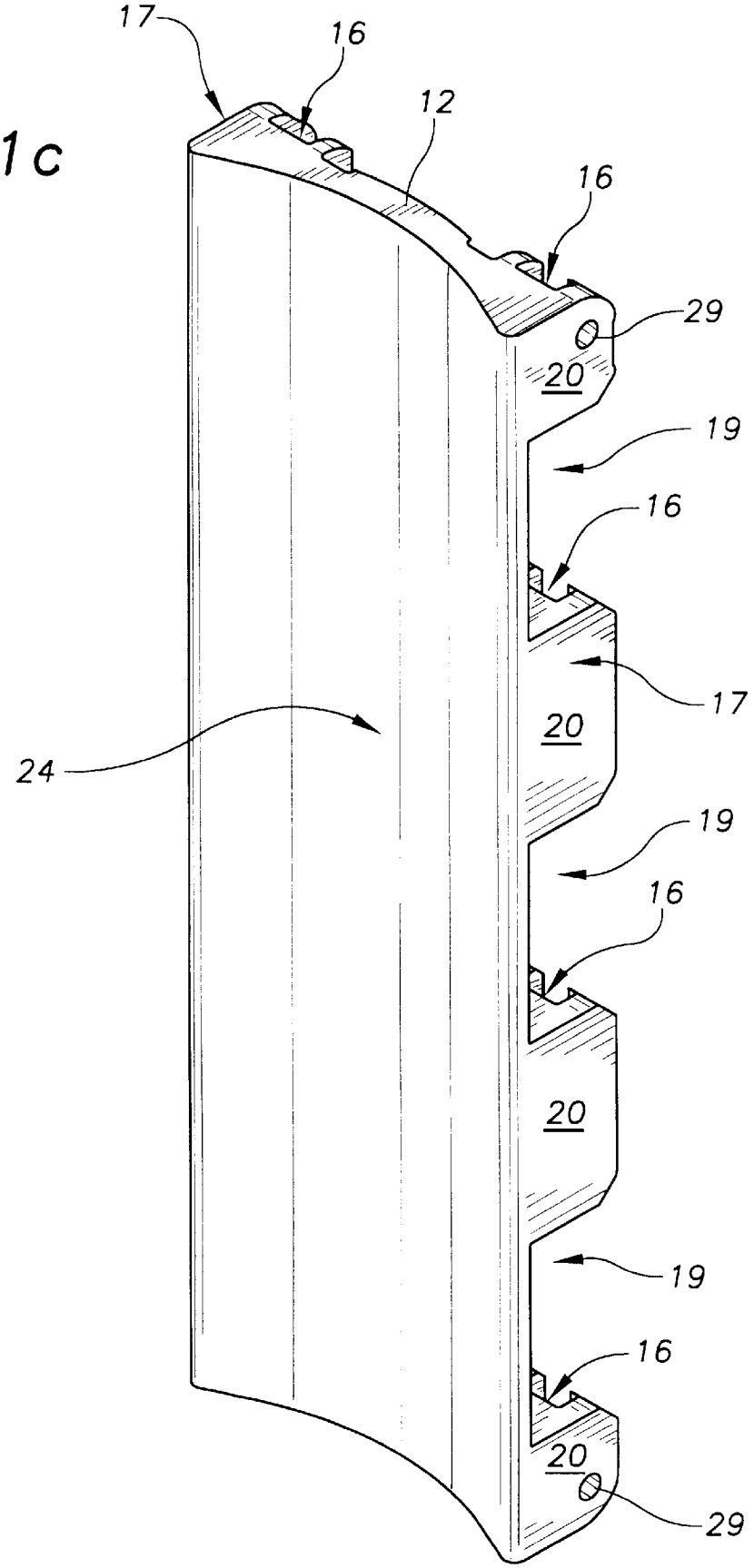
FIG. 1*c* shows a back perspective view of the mating tank mounting bracket plate of the oxygen tank mounting assembly depicted in FIG. 1.
Figure 1D:
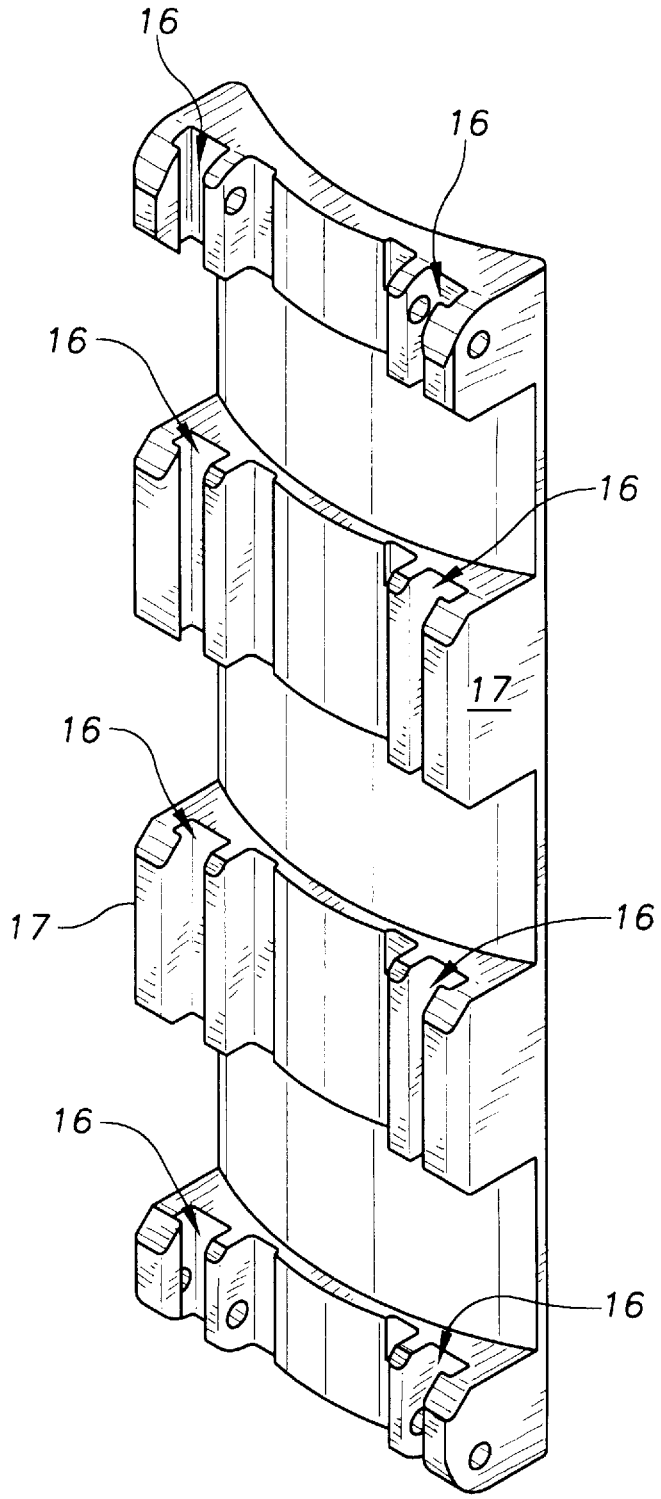
FIG. 1*d* depicts a front perspective view of the mating tank mounting bracket plate of the oxygen tank mounting assembly depicted in FIG. 1.

Now referring to FIGS. 1*a* and 1*b*, the base plate 11 is shown having a number of spaced-apart protuberances 14, disposed along side edges 15. The protuberances 14 act as a key that fits the spaced-apart, T-shaped apertures 16 disposed along the edges 17 of the oxygen tank mounting bracket 12, as shown in FIGS. 1, 1*c* and 1*d.*

Figure 2:
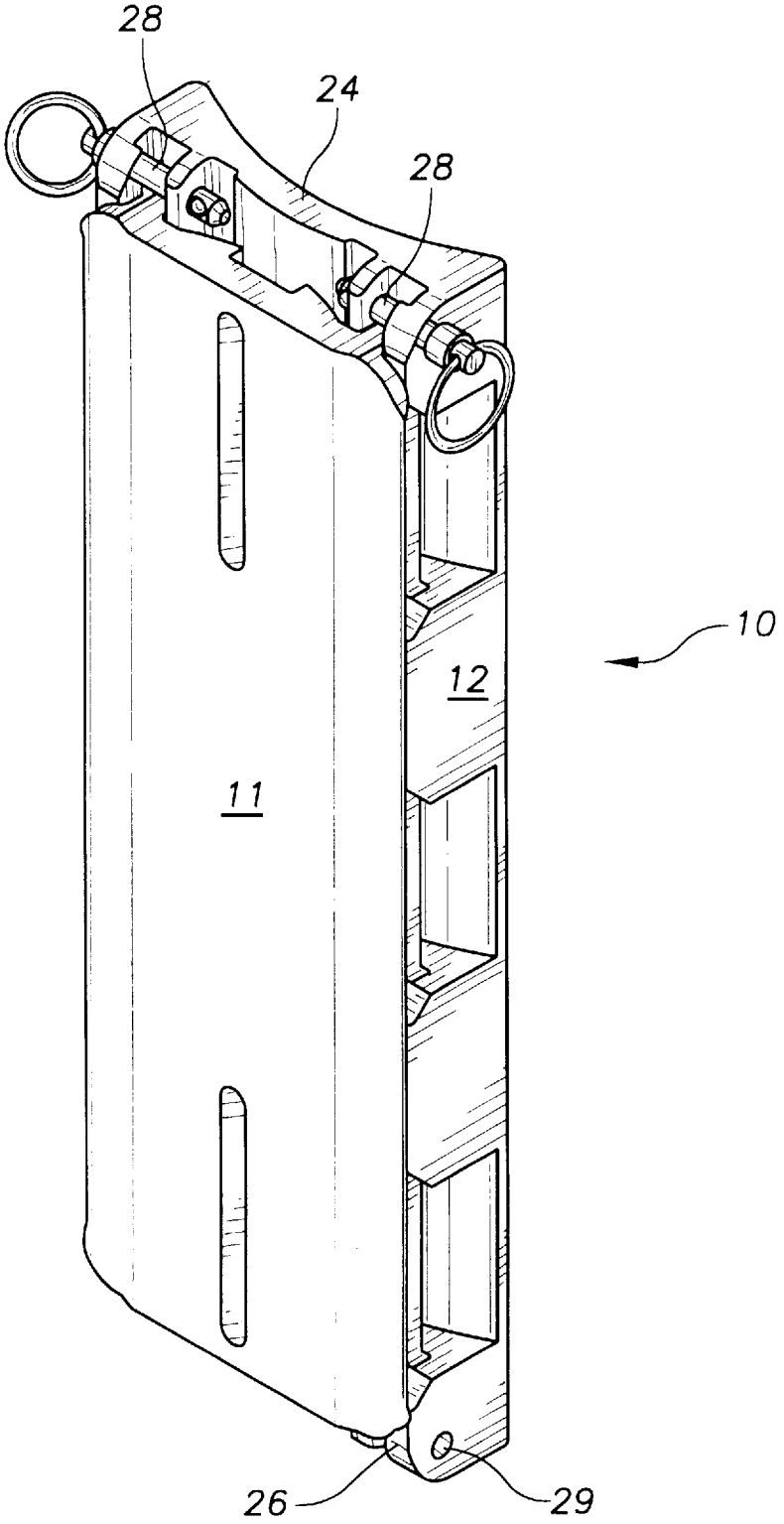
FIG. 2 depicts a perspective view of the mounting assembly illustrated in FIG. 1, as shown in the assembled position.

Referring again to FIG. 1, the base plate 11 is interconnected with the mounting bracket 12 by moving the protuberances 14 into the spaces 19 disposed between the abutments 20 comprising the T-shaped apertures 16, as shown by arrows 18. The protuberances 14 are first positioned over the T-shaped openings 16, and then the base plate 11 is moved downwardly (arrow 22), so that the protuberances 14 enter and slide into the openings 16, similar to a key entering the passageway of a lock. The protuberances 14 are captured in the T-shaped openings 16, such that base plate 11 cannot now separate from the mounting bracket 12. The assembled condition is shown in FIG. 2. Limiting abutments 26 stop the lowest protuberance 14 of base plate 11 from moving past the mounting bracket 12. Once located at its final resting position, the two interconnecting pieces 11 and 12 are secured by detent pins 28, which are placed into alignment holes 29.

Figure 2A:
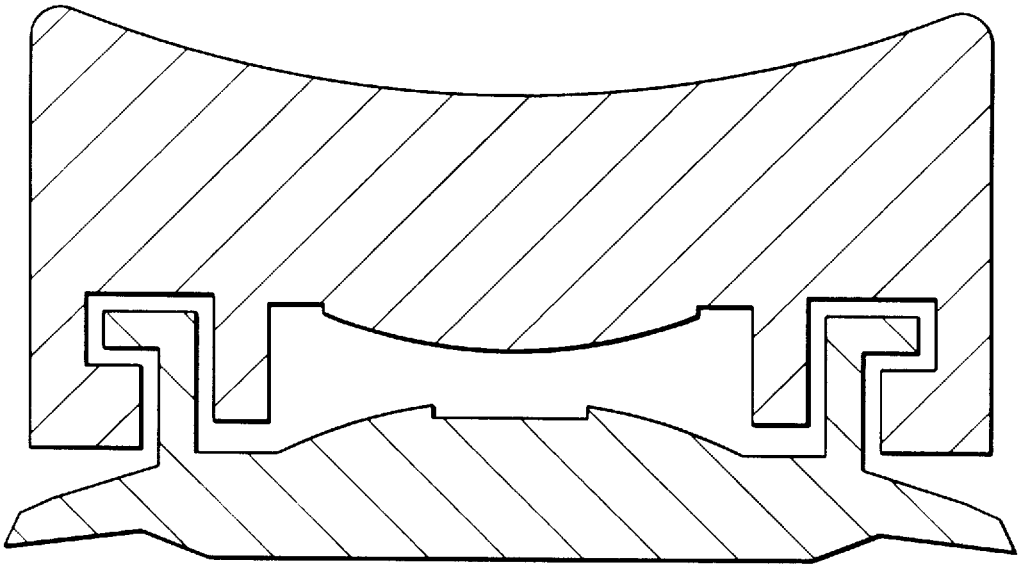
FIG. 2*a* is a sectional view of the mounting assembly shown in FIG. 2, wherein the protuberances are T-shaped.
Figure 2B:
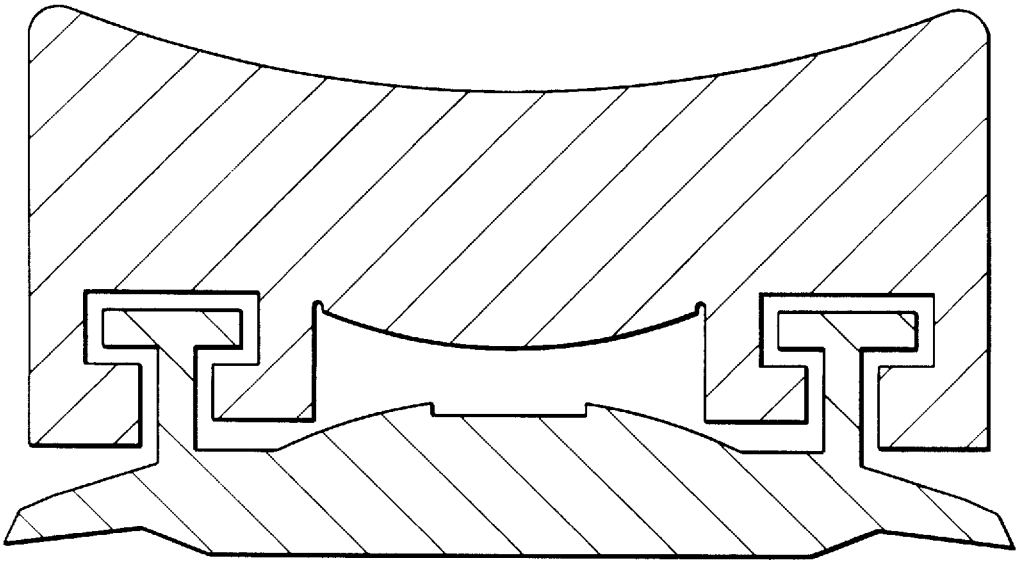
FIG. 2*b* is a sectional view of the mounting assembly shown in FIG. 2, wherein the protuberance are L-shaped.

Referring now to FIGS. 2*a* and 2*b,* there are shown sectional views of the mounting assembly of the invention. In FIG. 2*a,* protuberance 14 and receiving aperture 16 are T-shaped. FIG. 2*b* depicts an alternate embodiment of the inventive mounting assembly wherein protuberance 14' and corresponding aperture 16' are L-shaped.

Figure 3:
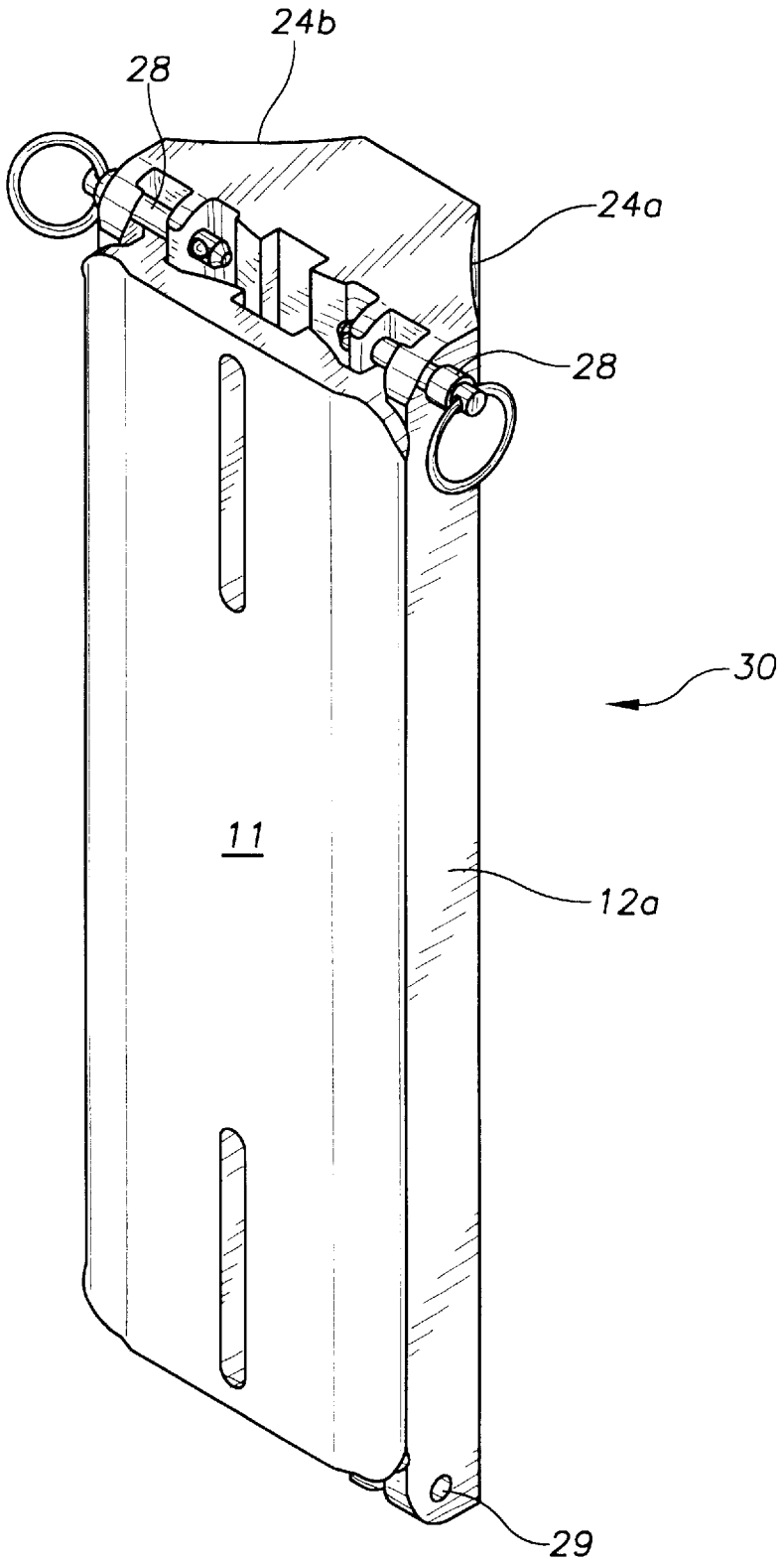
FIG. 3 shows an alternate embodiment of the mounting assembly illustrated in FIG. 1, with the oxygen tank mounting bracket designed for mounting two oxygen tanks.

Referring to FIG. 3, an alternate embodiment 30 of the mounting assembly illustrated in FIG. 1 is shown. In this embodiment, the oxygen tank mounting bracket 12*a* is designed for mounting two oxygen tanks, as depicted by the two curved surfaces 24*a* and 24*b*, respectively.

Figure 4:
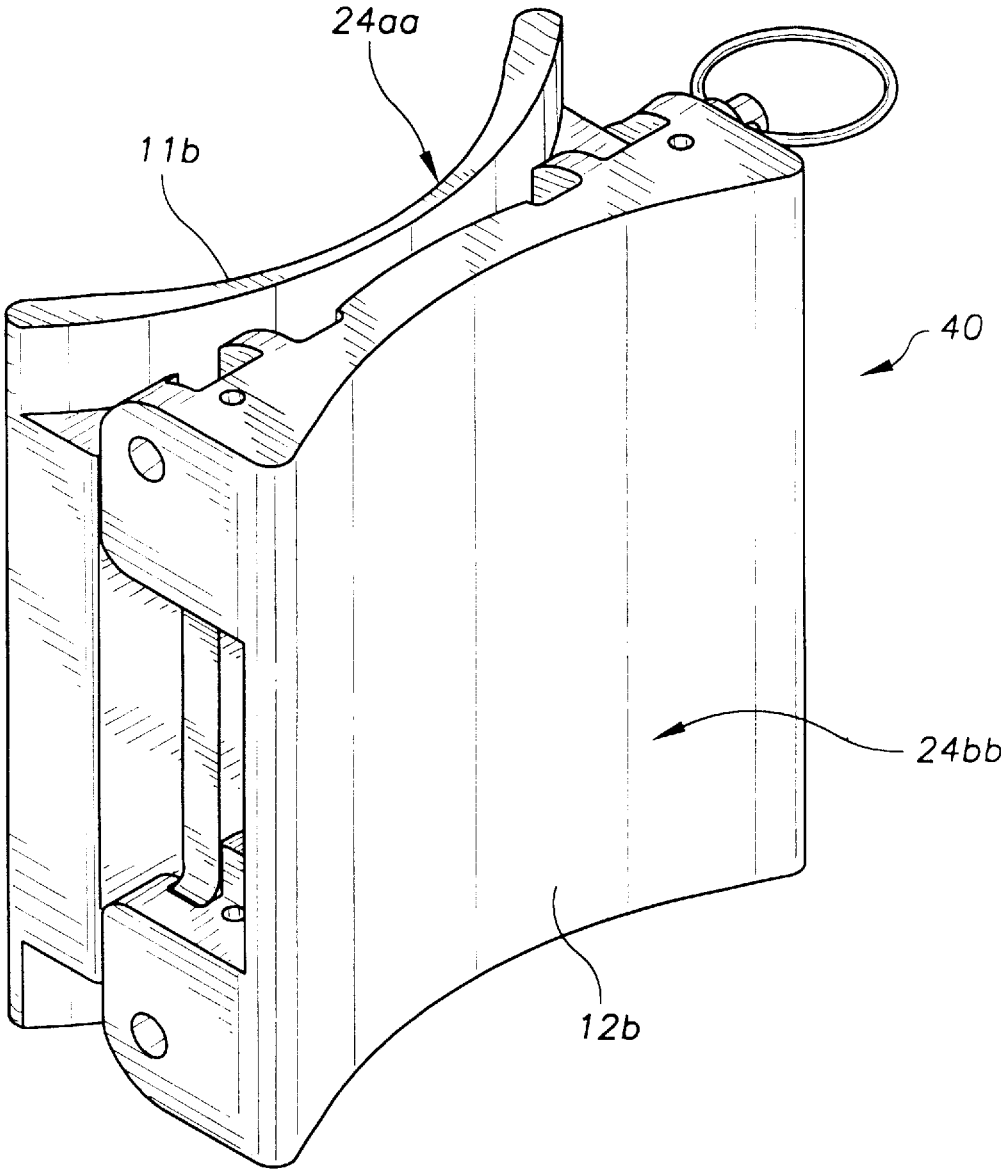
FIG. 4 illustrates a mounting assembly similar to that depicted in FIG. 1, that is used for mounting pony bottles.

Referring to FIG. 4, a mounting assembly 40 similar to that depicted in FIG. 1 is illustrated. The mounting assembly 40 comprises shortened plates 11*b* and 12*b*, respectively, and is used for mounting pony bottles (not shown). Surface 24*bb* is positioned over an oxygen tank cylinder. Surface 24*aa* conforms to, and accommodates the pony bottle. Strapping is used to attach the pony bottle to the tank.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A quickly assembled and disassembled mounting bracket system for mounting and dismounting an oxygen tank thereto, and therefrom, comprising:

a) a bracket assembly having a number of spaced-apart abutments with spaces between each pair of juxtaposed abutments, said abutments having means defining apertures therein, said apertures extending in a longitudinal direction with a lateral opening therealong and being further defined by an engaging surface;

b) a base plate that inter-engages with said bracket assembly, said base plate having a number of spaced-apart protuberances that conform to said engaging surface of said apertures and are received in said apertures of the abutments of said bracket assembly, said bracket assembly abutments being insertable in a lateral direction within said spaces of said base plate, and then longitudinally moved to a predetermined, fixed position wherein said protuberances are secured within said apertures to prevent the separation of said bracket assembly from said base plate in said lateral direction; and c) securing means associated with said bracket assembly for preventing movement in said longitudinal direction, whereby said bracket assembly is secured from further movement relative to said base plate, whereby a quick release of said bracket assembly from said base plate is executed by removing said securing means and sliding said bracket assembly to a position wherein said protuberances are positioned opposite said spaces and said bracket assembly is removed from said base plate in a lateral direction.

2. The mounting bracket system for mounting and dismounting an oxygen tank in accordance with claim 1, wherein said engaging surface of said apertures of said abutments has a T-shape.

3. The mounting bracket system for mounting and dismounting an oxygen tank in accordance with claim 1, wherein said engaging surface of said apertures of said abutments has an L-shape.

4. The mounting bracket system for mounting and dismounting an oxygen tank in accordance with claim 1, wherein said securing means associated with said bracket assembly comprises a detent pin, and further wherein one of said abutments has an aperture for receiving said detent pin, said detent pin being insertable in said aperture, whereby said bracket assembly is prevented from movement with respect to said base plate.

5. The mounting bracket system for mounting and dismounting an oxygen tank in accordance with claim 1, wherein said mounting bracket assembly comprises an arcuate surface, said arcuate surface comprising a portion of a cylindrical surface conforming to said oxygen tank.

6. The mounting bracket system for mounting and dismounting an oxygen tank in accordance with claim 1, wherein said arcuate surface comprises means for supporting a pony bottle.

7. A quickly assembled and disassembled mounting bracket system for mounting and dismounting an pony bottle thereto and therefrom, comprising:

a) a bracket assembly having a number of spaced-apart abutments with spaces between each pair of juxtaposed abutments, said abutments having means defining apertures therein, said apertures extending in a longitudinal direction with a lateral opening therealong and being further defined by an engaging surface;

b) a base plate that inter-engages with said bracket assembly, said base plate having a number of spaced-apart protuberances that conform to said engaging surface of said apertures and are received in said apertures of the abutments of said bracket assembly, said bracket assembly abutments being insertable in a lateral direction within said spaces of said base plate, and then longitudinally moved to a predetermined, fixed position wherein said protuberances are secured within said apertures to prevent the separation of said bracket assembly from said base plate in said lateral direction; and c) securing means associated with said bracket assembly for preventing movement in said longitudinal direction, whereby said bracket assembly is secured from further movement relative to said base plate, whereby a quick release of said bracket assembly from said base plate is executed by removing said securing means and sliding said bracket assembly to a position wherein said protuberances are positioned opposite said spaces and said bracket assembly is removed from said base plate in a lateral direction.

8. The mounting bracket system for mounting and dismounting a pony bottle in accordance with claim 7, wherein said engaging surface of said apertures of said abutments has a T-shape.

9. The mounting bracket system for mounting and dismounting a pony bottle in accordance with claim 7, wherein said engaging surface of said apertures of said abutments has an L-shape.

10. The mounting bracket system for mounting and dismounting a pony bottle in accordance with claim 7, wherein said securing means associated with said bracket assembly comprises a detent pin, and further wherein one of said abutments has an aperture for receiving said detent pin, said detent pin being insertable in said aperture, whereby said bracket assembly is prevented from movement with respect to said base plate.

11. The mounting bracket system for mounting and dismounting a pony bottle in accordance with claim 7, wherein said mounting bracket assembly comprises an arcuate surface, said arcuate surface comprising a portion of a cylindrical surface conforming to said pony bottle.

* * * * *